US007162843B2

(12) United States Patent
Hardy

(10) Patent No.: US 7,162,843 B2
(45) Date of Patent: Jan. 16, 2007

(54) BOLTS WITH CONNECTED ANCHOR

(75) Inventor: Gary L. Hardy, Camarillo, CA (US)

(73) Assignee: Mitek Holdings, Inc., Wilmington, DE (US)

( * ) Notice: Subject to any disclaimer, the term of this patent is extended or adjusted under 35 U.S.C. 154(b) by 349 days.

(21) Appl. No.: 10/640,732

(22) Filed: Aug. 14, 2003

(65) Prior Publication Data

US 2005/0055956 A1 Mar. 17, 2005

(51) Int. Cl.
*E04H 1/00* (2006.01)

(52) U.S. Cl. ..... 52/236.5

(58) Field of Classification Search ..... 52/293.3, 52/295, 714

See application file for complete search history.

(56) References Cited

U.S. PATENT DOCUMENTS 1,816,226 A * 7/1931 Krabiel ..... 52/370
4,294,052 A 10/1981 Blauer
5,218,803 A 6/1993 Wright
5,493,834 A 2/1996 Nelson
5,664,388 A 9/1997 Chapman et al.
5,706,626 A * 1/1998 Mueller ..... 52/800.12
5,729,950 A 3/1998 Hardy
5,987,828 A 11/1999 Hardy
5,992,125 A 11/1999 Hardy
6,006,487 A * 12/1999 Leek ..... 52/698
6,018,917 A * 2/2000 Leek ..... 52/250
6,067,769 A 5/2000 Hardy
6,148,583 A 11/2000 Hardy
6,212,849 B1 4/2001 Pellock
6,219,989 B1 * 4/2001 Tumura ..... 52/726.3
6,658,806 B1 12/2003 Leek
2001/0002529 A1 6/2001 Commins et al.

* cited by examiner

*Primary Examiner*—Sarah Purol
(74) *Attorney, Agent, or Firm*—Senniger Powers

(57) ABSTRACT

A fastener includes a plurality of elongate, threaded studs which are connected to a common anchor portion for securing a frame member to a foundation. Attached to the anchor portion is a receiving element adapted to receive a positioner. The studs, anchor and receiving element are a one-piece integral assembly constructed of steel or high tensile strength steel. In addition, the fastener is adapted to receive a template and positioner for stability during the pouring and curing of the foundation.

14 Claims, 6 Drawing Sheets

BOLTS WITH CONNECTED ANCHOR

BACKGROUND OF THE INVENTION

This invention generally relates to structural reinforcement devices, and in particular to fasteners used to secure a frame member to a foundation.

Buildings and other structures are exposed to natural occurrences such as earthquakes, tornados, hurricanes and high winds which can cause damage when design loads are exceeded. Typically, damage results from either shear forces, which pull or tear apart a portion of a building, or uplifting forces, which cause separation of a structural frame of the building from its foundation. In an effort to prevent damage from shear forces, the structural frame is commonly braced or reinforced. Several approaches are explained in Hardy U.S. Pat. Nos. 6,148,583, 6,067,769 and 5,729,950.

In an effort to prevent damage from uplifting forces, the structural frame is commonly secured to the foundation using a plurality of fasteners. Building codes typically specify the required fastener length and diameter as well as their placement within the foundation. Typically, these fasteners are vertically oriented, metallic anchor bolts which extend through the structural frame and into a foundation material. An anchor bolt consists of two ends; a stud and an anchor portion. The stud, which has a threaded end, protrudes above the concrete for use in fastening a building frame to the foundation using a standard threaded nut and washer assembly. The anchor portion is commonly configured in a "J" or "L" located within the foundation to secure the bolt in the foundation. In addition, eye bolts, "U" bolts, headed bolts or headed bolts with washers are sometimes used.

The effectiveness of the anchor bolt in preventing damage is dependent on its own strength, the type of foundation material in which the anchor portion is set and the connection between the foundation material and anchor portion. The connection between the foundation material and anchor portion is established by the configuration of the anchor portion. The configurations of conventional anchors vary substantially and are dependent on whether the anchor was designed to be installed prior to or after the laying of the foundation material. Anchor portions designed to be installed after the foundation material is laid are typically bonded into holes which are pre-drilled into an existing foundation. Anchor bolts designed to be set into position prior to pouring the foundation material are usually placed into position by affixing each bolt to a metal or wooden support using bailing wire. These anchor portions are embedded in the foundation. As a result, anchor bolts with anchor portions embedded in the foundation have a substantially greater tensile capacity compared to those installed after the foundation is laid.

Unfortunately, the capability of an embedded anchor bolt to provide tensile strength to a frame member is degraded if the anchor bolt is not positioned properly, becomes misaligned during the pouring of the foundation or does not adequately penetrate the foundation. Moreover, the stud may protrude through the foundation at the wrong position making it difficult to secure the structural frame to the foundation and compromising its effectiveness. Further, the tasks of positioning and securing each anchor bolt to the support are time consuming, labor intensive and correspondingly costly.

SUMMARY OF THE INVENTION

Accordingly, among the several objects of the present invention is the provision of a fastener capable of effectively fastening a frame member of a building or other structure to a foundation; the provision of such a fastener which can be accurately and securely positioned in the foundation; the provision of such a fastener which is easily positioned in the foundation; and the provision of such a fastener capable of reducing installation costs.

A fastener constructed according to the present invention is for use in securing the frame member to the foundation. Generally, the fastener comprises a plurality of elongate studs disposed in spaced-apart relation to one another for connection to the frame member. At least a portion of the studs are disposed generally in a stud plane. Each stud has a first and second free ends. An anchor portion is connected to the studs away from the first ends and extending outwardly from the stud plane. The anchor portion is adapted to secure the fastener in the foundation.

In another aspect, the fastener comprises the plurality of elongate studs that are disposed in spaced-apart relation to one another for connection to the frame member and have a central longitudinal axes. Each stud has the first and second free ends. An anchor portion is connected to the studs away from the first ends and extending outwardly from the central longitudinal axes of the studs. A receiving element of the fastener is adapted to receive a positioner for positioning the fastener within the foundation.

In yet another aspect, a one-piece fastener comprises two elongate studs disposed in spaced-apart relation to one another for connection to the frame member with at least a portion of the studs being disposed generally in a stud plane. Each stud has a first free end with threads thereon and a second end. An anchor portion connected to the second ends of the studs interconnects the studs and extends outwardly at an angle of at least about 20° from the stud plane. The anchor portion includes an opening adapted to receive the positioner for positioning the fastener within the foundation.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
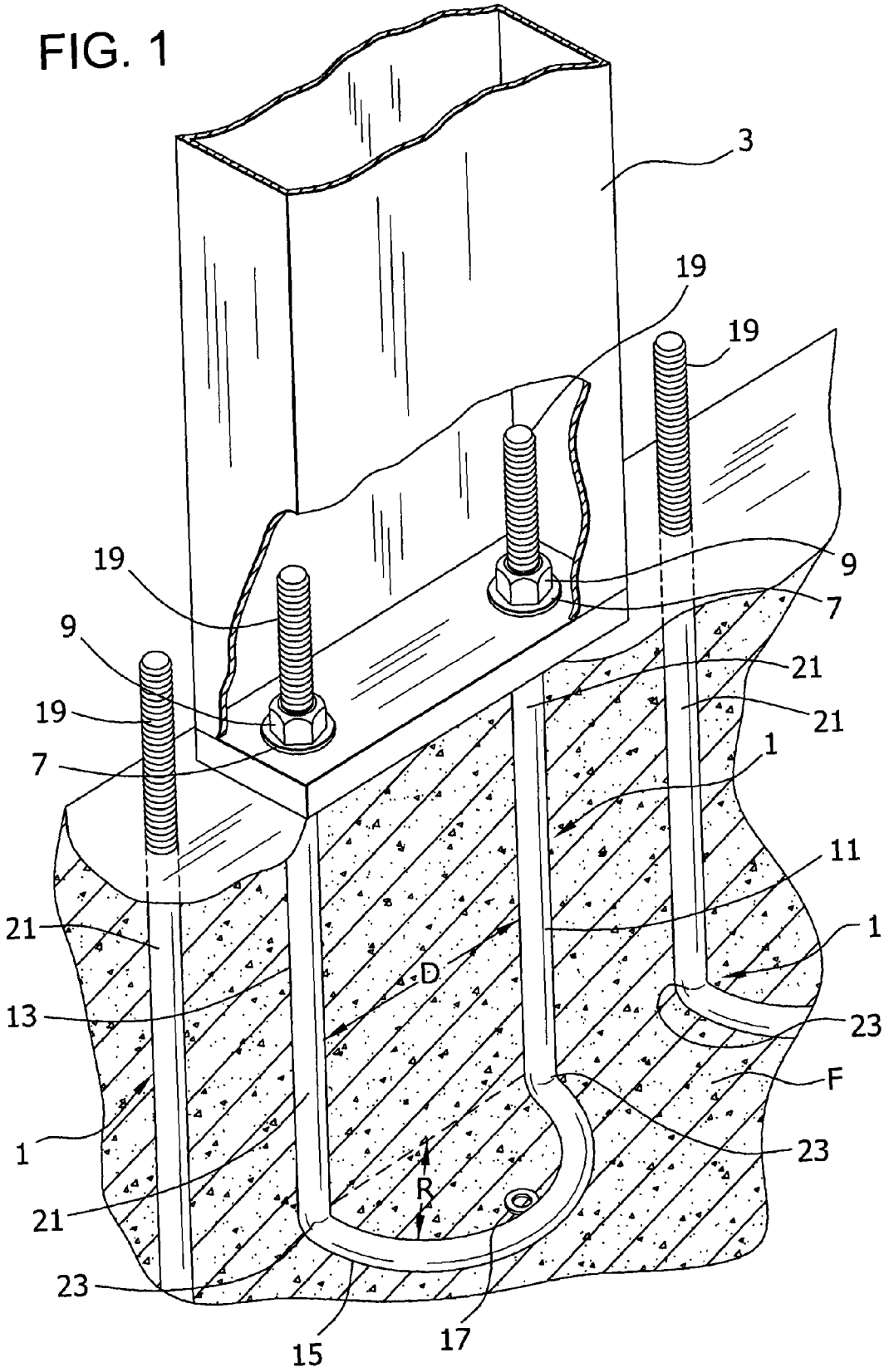
FIG. 1 is a fragmentary perspective illustrating an anchor bolt of the present invention embedded in a concrete foundation and securing a frame structure, with parts broken away to show details.

Referring now to the drawings and in particular to FIG. 1, a fastener according to the present invention embedded in a foundation F is indicated generally. Also shown are several fragments of other studs. The fastener positively secured framing members, such as framing member 3, of buildings or other engineered structures to resist shear and uplifting forces. Only a small fragment of the framing member 3 is illustrated in FIG. 1. Another suitable framing member is the commercially available Hardy Frame System manufactured by Hardy Frames, Inc. of Ventura, Calif. The fastener 1 is embedded in a foundation F of a suitable material such as concrete. The framing member 3 is secured to ends of the fastener 1 which protrude above the foundation F, using a standard washer 7 and nut 9.

The fastener 1 is a generally U-shaped, cylindrical rod further modified by bending the base of the U outwardly. In one embodiment the cylindrical rod has a diameter of ⅞-inches. Two linear arms of the U are the studs 11, 13 in the illustrated embodiment. The base of the U which extends outwardly defines an anchor portion 15 in the illustrated embodiment. Welded to the anchor portion is a receiving element or ring 17, the purpose for which is further described below. The studs 11, 13, anchor portion 15 and ring 17 comprise a one-piece assembly. The fastener 1 is constructed of a suitable material such as a rod of either steel or high tensile capacity steel.

Figure 4:
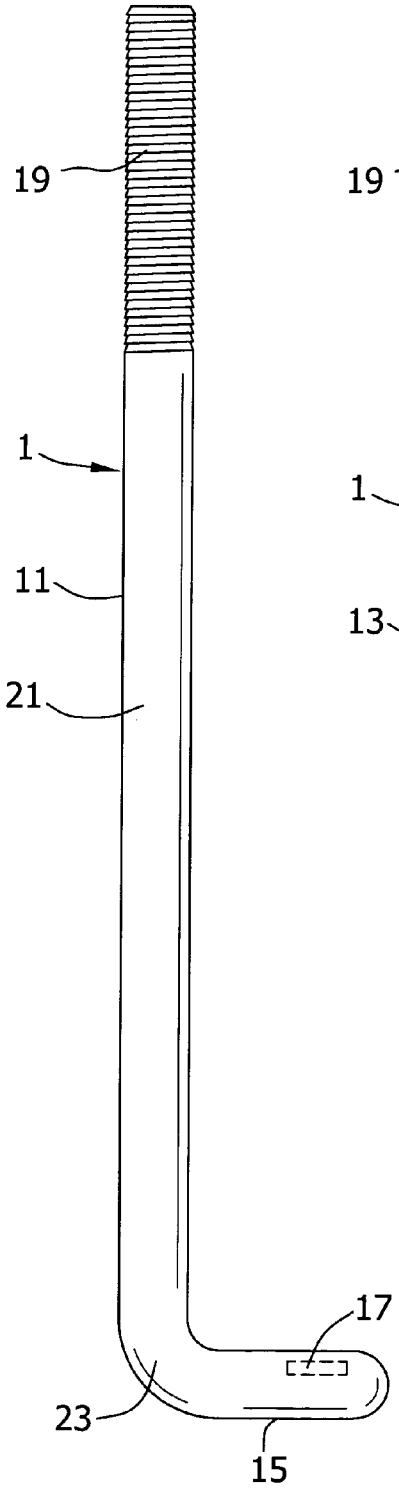
FIG. 4 is a left side elevation of the anchor bolt of FIG. 1.
Figure 5:
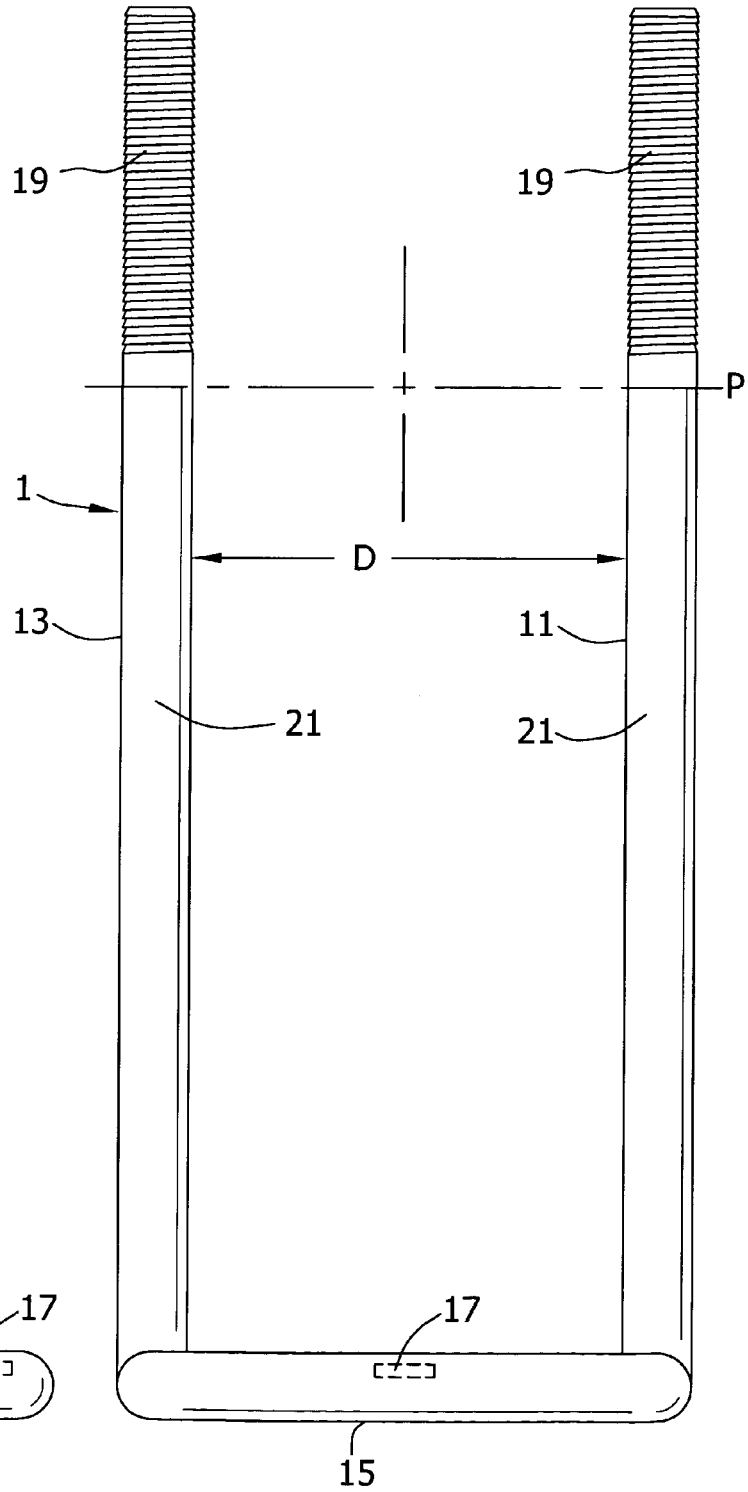
FIG. 5 is a front elevation of the anchor bolt of FIG. 1.
Figure 6:
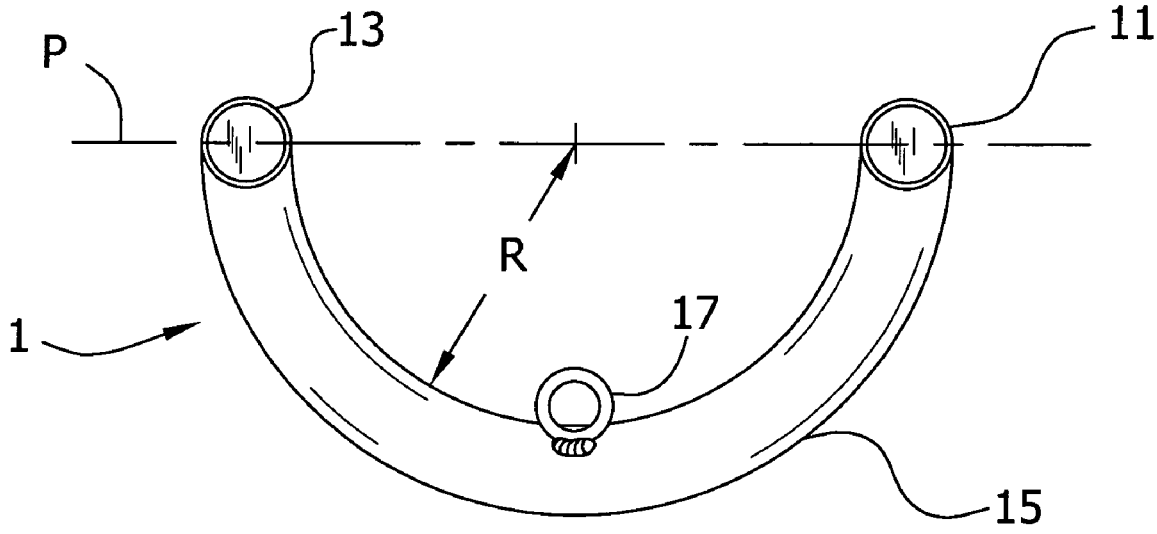
FIG. 6 is a top plan view illustrating the anchor bolt of FIG. 1.

The two studs 11, 13 are located substantially in a common plane P (see FIGS. 4–6) with the distance D between each stud varying depending on intended use. However, the studs 11, 13 could be other than coplaner without departing from the scope of the present invention. In the preferred embodiments, the studs 11, 13 are set at either 8½-inches, 14½-inches or 20½-inches apart. Each stud 11, 13 comprises a threaded end 19 and a shank 21. The threaded end, which is opposite from the anchor portion 15, is used to secure the framing member 3 to the foundation F using the washer 7 and nut 9 (FIG. 1). In one embodiment, the threaded end 19 has a nominal length of 5 inches. However, the threaded end 19 can be set to any length suitable for a particular application. Beneath the threaded end 19 is the shank 21, a straight, cylindrical segment. In one embodiment, the shank 21 has a nominal length of 16 inches which provides the spacing necessary for the threaded end 19 to adequately protrude above the foundation F and the anchor portion 15 to adequately embed in the foundation. It is to be understood that the length of the shank 21 may be other than 16 inches without departing from the scope of this invention.

Figure 7:
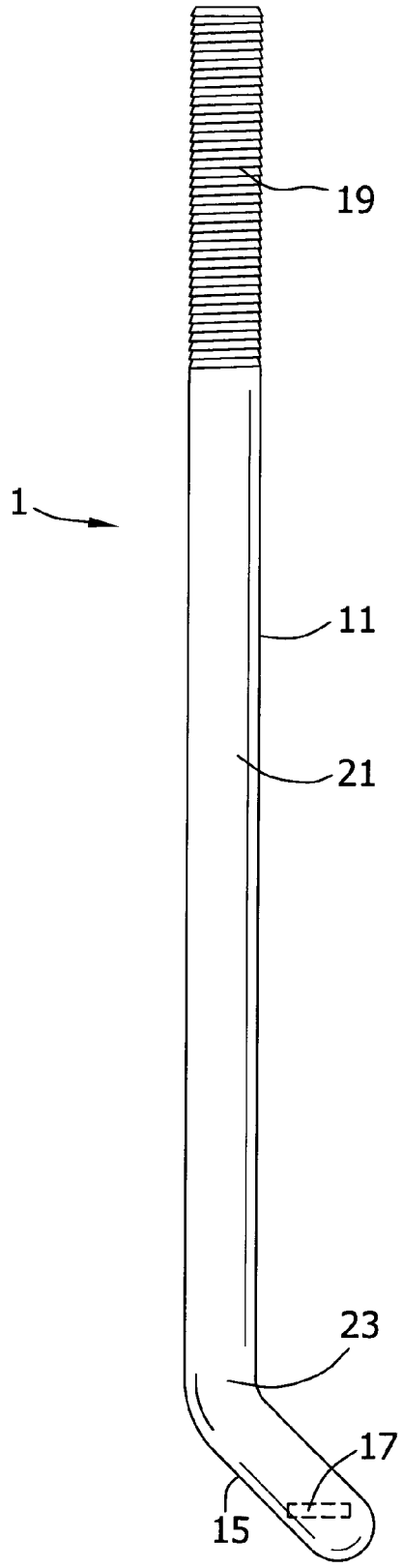
FIG. 7 is a right side elevation illustrating an anchor bolt having a 45 degree bend.

Immediately below the shank 21 is a bend 23 followed by the anchor portion 15. The bend 23 can be set to various angles with the two illustrated embodiments being either 45 degrees (FIG. 7) and 90 degrees (FIG. 4) from the plane P of the studs 11, 13. The anchor portion 15 of the fastener 1 has a nominal length of 1½ inches. As a result of the plane change at the bend 23, the anchor portion 15 has horizontal projection orthoganal to the plane P of the studs 11, 13. Thus, the anchor portion 15 is able to laterally penetrate into the foundation F. The anchor portion 15 is arcuate, and a radius of curvature R of the arcuate member can be changed based on its intended use. In certain embodiments of the arcuate member, radii are approximately 4 inches, 6½ inches and 9½ inches.

The ring 17 is welded in a horizontal position near the center of the anchor portion 15 between the studs 11, 13. The ring 17 is sized to permit a cylindrical positioning rod 29 to pass through. In one embodiment, the ring 17 is a ⅞ inch washer. The positioning rod 29, which is made of a suitable material such as steel, is used to stabilize the fastener 1 during the pouring of the foundation F. The positioner 29 passes through the receiving element 17 and is fixed firmly in foundation F. After the foundation is poured but before it cures, the positioner 29 can be removed.

Figure 2:
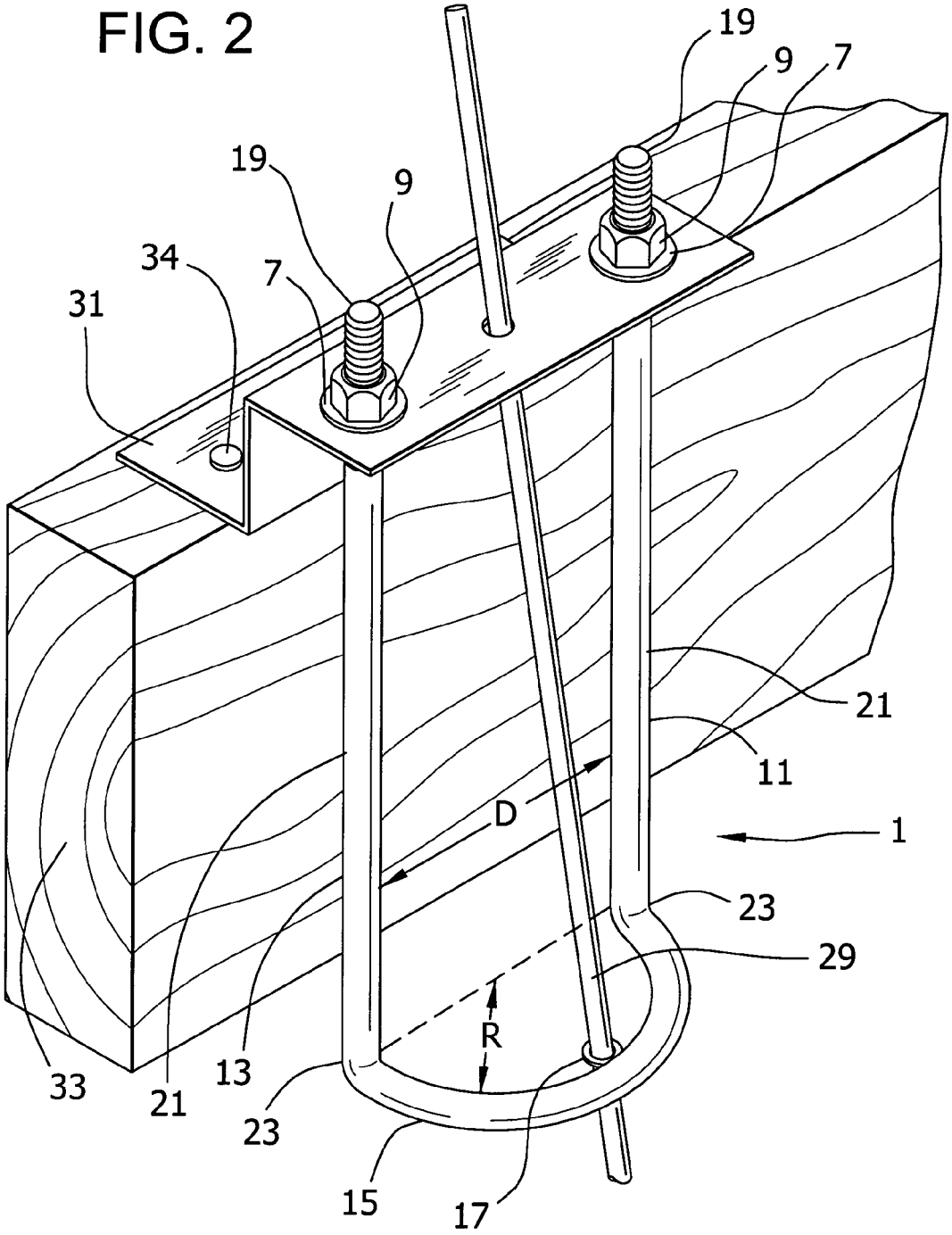
FIG. 2 is a perspective of the anchor bolt of FIG. 1 stabilized using a positioner and a template.
Figure 3:
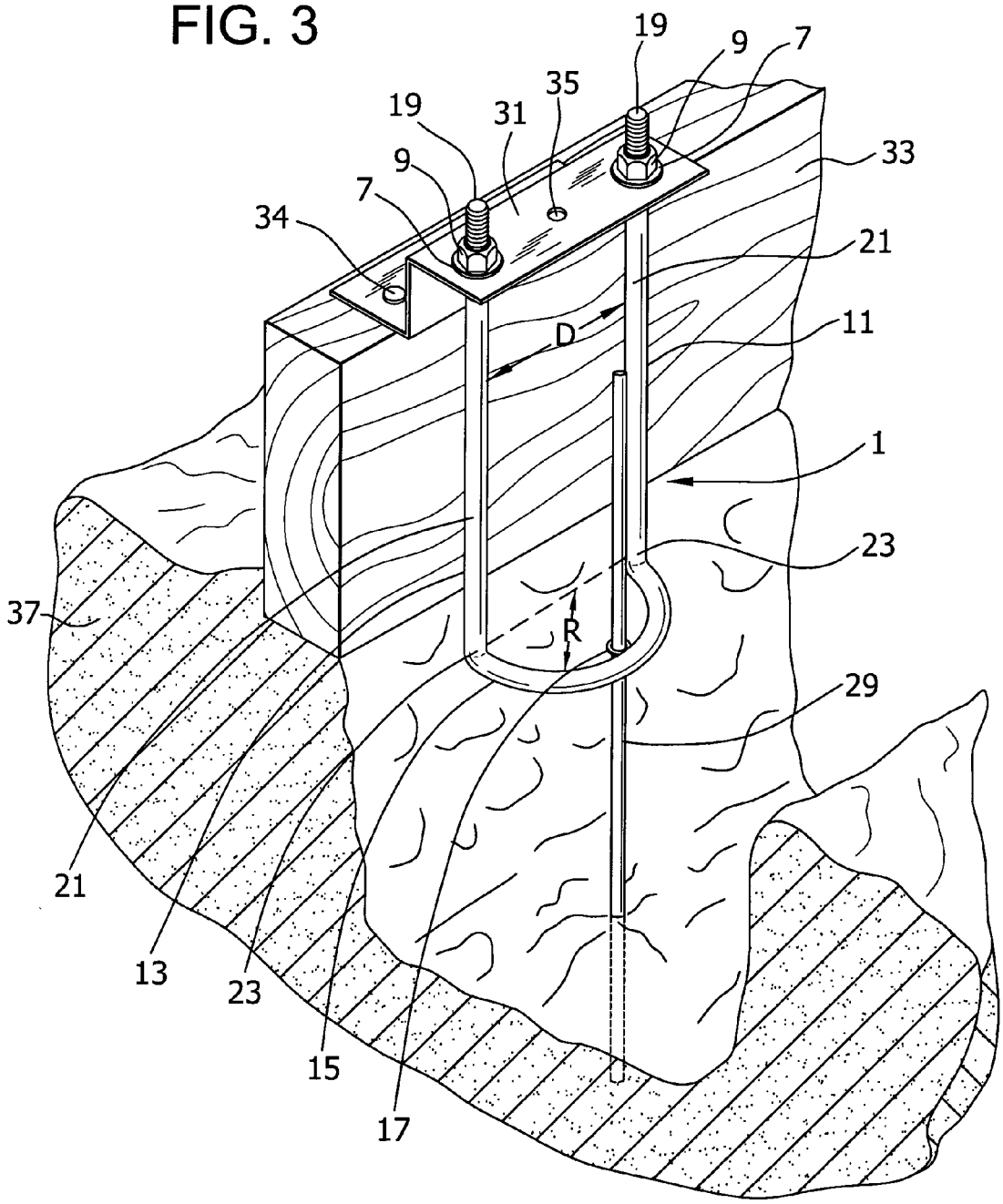
FIG. 3 is a perspective illustrating the anchor bolt of FIG. 1 stabilized using an alternative employment of the positioner and template.

A template 31, as shown in FIGS. 2 and 3, is secured to a form board 33 using nails 34 to stabilize the fastener 1 during the pouring and curing of the foundation F. The template. 31 includes holes for receiving each of the threaded ends 19 and the positioner 29 (FIG. 2). The positioner 29 is passed through the center template hole 35, the ring 17 and fixed firmly in a foundation base 37 of a suitable material such as gravel or soil. In addition, the threaded ends 19 are fastened to the template 31 using a standard washer 7 and nut 9 combination. Alternatively, as shown in FIG. 3, the template 31 can be used to stabilize the fastener 1 by passing the positioner 29 only through the ring 17 and not center template hole 35. As before, the threaded ends 19 of the fastener 1 are attached to the template 31 using a washer 7 and nut 9 combination. After the foundation F is poured but before it cures, the positioner 29 can be removed. In still another configuration (not shown), the template 31 can be used to stabilize the fastener 1 without the positioner 29 by fastening the thread ends 19 to the template using a washer 7 and nut 9 combination. Since the template 31 does not come into contact with the foundation F, it can be removed after the foundation has cured.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A fastener for use in securing a frame member to a foundation comprising:

elongate studs disposed in spaced-apart relation to one another for connection to the frame member, at least a portion of each stud being disposed generally in a stud plane, each stud having a first free end and a second end, each stud including threads adjacent the free end for mating engagement with a threaded nut for securing the frame member to the foundation; and an anchor portion connected to the studs away from the first ends thereof and extending outwardly from the stud plane at an angle of at least about 20° from the stud plane, the anchor portion being adapted to secure the fastener in the foundation;

the elongate studs and anchor portion being formed as a one-piece construction.

2. A fastener as set forth in claim 1 wherein the anchor portion is connected to the second ends of the studs and interconnects the studs.

3. A fastener as set forth in claim 2 further comprising a receiving element adapted to receive a positioner for positioning the fastener within the foundation.

4. A fastener as set forth in claim 1 wherein the anchor portion includes a receiving element adapted to receive a positioner for positioning the fastener within the foundation.

5. A fastener as set forth in claim 4 wherein the receiving element comprises an opening for receiving the positioner.

6. A fastener as set forth in claim 1 wherein the anchor portion extends at an angle of at least about 40° from the stud plane.

7. A fastener as set forth in claim 1 wherein the anchor portion extends generally perpendicular to the stud plane.

8. A fastener as set forth in claim 1 wherein the fastener is made of steel.

9. A fastener as set forth in claim 1 wherein the fastener is made of high tensile strength steel.

10. A fastener for use in securing a frame member to a foundation comprising:

elongate studs disposed in spaced-apart relation to one another for connection to the frame member and having central longitudinal axes, each stud having a first free end and a second end;

an anchor portion connected to the studs away from the first ends thereof and extending outwardly from the central longitudinal axes of the studs, and a receiving element mounted on the anchor portion, the receiving element comprising an opening adapted to receive a positioner for positioning the fastener within the foundation, the elongate studs and anchor portion being formed as a one-piece construction.

11. A fastener as set forth in claim 10 wherein the central longitudinal axes of the studs are disposed generally in a stud plane and wherein the anchor portion extends outwardly from the stud plane.

12. A fastener as set forth in claim 11 wherein the anchor portion extends at an angle of at least about 40° from the stud plane.

13. A one-piece fastener for use in securing a frame member to a foundation comprising:

two elongate studs disposed in spaced-apart relation to one another for connection to the frame member, at least a portion of the studs being disposed generally in a stud plane, each stud having a first free end having threads thereon and a second end; and an anchor portion connected to the second ends of the studs for interconnecting the studs and extending outwardly at an angle of at least about 20° from the stud plane, the anchor portion including an opening adapted to receive a positioner for positioning the fastener within the foundation.

14. A fastener as set forth in claim 13 in combination with a template and the positioner, the template including holes for receiving the studs and the positioner whereby passing the positioner through the opening of the anchor portion and one of the template holes positions the fastener within the foundation.

* * * * *